United States Patent [19]

Swierczek

[11] Patent Number: 5,017,176

[45] Date of Patent: May 21, 1991

[54] COIN HOPPER AND DISPENSER

[75] Inventor: Remi D. Swierczek, Concord, Ohio

[73] Assignee: Dixiw-Narco, Inc., Ranson, W. Va.

[21] Appl. No.: 470,381

[22] Filed: Jan. 25, 1990

[51] Int. Cl.[5] ..... G07D 1/00

[52] U.S. Cl. ..... 453/49; 221/182; 221/203; 221/265

[58] Field of Search ..... 453/33, 49, 57; 221/182, 203, 265; 222/328, 349, 350

[56] References Cited

U.S. PATENT DOCUMENTS 2,176,232 10/1939 Warren et al. ..... 221/265
4,407,312 10/1983 Davila et al. ..... 453/33 X
4,441,515 4/1984 Goepner ..... 221/203 X

*Primary Examiner*—F. J. Bartuska
*Attorney, Agent, or Firm*—Renner, Kenner, Greive, Bobak, Taylor & Weber

[57] ABSTRACT

A bulk coin hopper and dispenser is provided with a pair of rotating discs at the bottom thereof. A baffle shields the discs from the weight of the coins within the hopper, while a flexible flap is maintained adjacent to the discs to urge coins into coin receiving bores within a top one of such discs. A stationary plate having a single bore therethrough is interposed between the two discs. Rotation of the two discs over the surfaces of the stationary plate allows for singular dispensing of coins from the bores through the plate.

9 Claims, 2 Drawing Sheets

COIN HOPPER AND DISPENSER

The invention herein resides in the art of currency validators and changers. More particularly, the invention relates to hoppers and dispensers for maintaining and dispensing coins upon command from a currency validator, changer, or the like.

BACKGROUND ART

Many known coin dispensing systems are presently available. Such coin dispensers are typically used in conjunction with currency validators, changers, vending systems, and the like. In some coin dispensing systems, the coins to be despensed are first escrowed and then dispensed at once into a receptacle for retrieval by the user. Other coin dispensing systems provide for the dispensing of coins from a bulk hopper, the dispensed coins being counted at the time of dispensing, obviating the need for an escrow position. Such coin dispensing systems are more versatile in operation than the escrow type, and are also more compact and simplistic in structure since the need for an escrow area is eliminated.

It has been found that dispensing systems which dispense coins directly from a bulk hopper are sometimes given to problems which, if unremedied, would render the system inoperative. If a coin jams between two members of the dispensing system, one or more of which is intended to rotate or move, further operation of the coin dispensing is prohibited. Further, it has been found that in such dispensers groups of coins will axially align as "rollers," rolling across a dispensing disc or other dispensing structure. These "rollers" assume a posture orthogonal to that which would be necessary for the actual dispensing operation and, by doing so, impede the dispensing operation. It is furthe known that coins in bulk hoppers will often "bridge" the dispensing area, by forming an array or mat of coins which prevents the ingress of other coins to the dispensing area, again preventing effective operation of the dispensing system. It has also been found in such systems that coins will often "wedge" in a dispensing cylinder or bore, lying therein in a vertical rather than horizontal position, not only inhibiting dispensing of that particular coin, but also the entry of other coins into the bore or cylinder.

It has also been found in coin dispensers, coin bulk hoppers and the like that the mass of weight imparted by the coins at the bottom of the hopper will often impede th effective operation of rotating discs or the like positioned at the bottom of the hopper for achieving the dispensing function. Further, such prior bulk hoppers have given little direction or assistance to coins in urging them into the dispensing bore or cylinder.

DISCLOSURE OF INVENTION

In light of the forgoing, it is a first aspect of the invention to provide a coin hopper and dispenser in which a dispensing disc at the bottom of the hopper is shielded from the bulk load of coins received therein.

Another aspect of the invention is the provision of a coin hopper and dispenser which includes means for preventing bridging, wedging, or rolling of the coins upon the dispensing disc.

Still a further aspect of the invention is the provision of a coin hopper and dispenser which is not given to jamming.

An additional aspect of the invention is the provision of a coin hopper and dispenser which includes means for directing and assisting coins in reaching the dispensing area in an appropriate posture.

Still a further aspect of the invention is the provision of a coin hopper and dispenser which is efficient, reliable and durable in operation, and readily conducive to implementation with state of the art components.

The forgoing and other aspects of the invention which will become apparent as the detailed description proceeds are achieved by a coin dispenser, comprising: a hopper for receiving a bulk supply of coins; first and second rotatable plates positioned at a bottom end of said hopper; and a third stationary plate interposed between said first and second rotatable plates.

Other aspects of the invention which will become apparent herein are attained by a coin dispenser, comprising: a hopper for receiving coins; first and second discs closing a bottom end of said hopper, said first and second discs being affiexed to a shaft and being rotatble in unison by rotation of said shaft, said first and second discs being oblique to horizontal and vertical planes; and a stationary plate interposed between said first and second discs.

DESCRIPTION OF DRAWINGS

For a complete understanding of the objects, techniques and structure of the invention reference should be made to the following detailed description and accompanying drawings wherein.

BEST MODE FOR CARRYING OUT THE INVENTION

Figure 1:
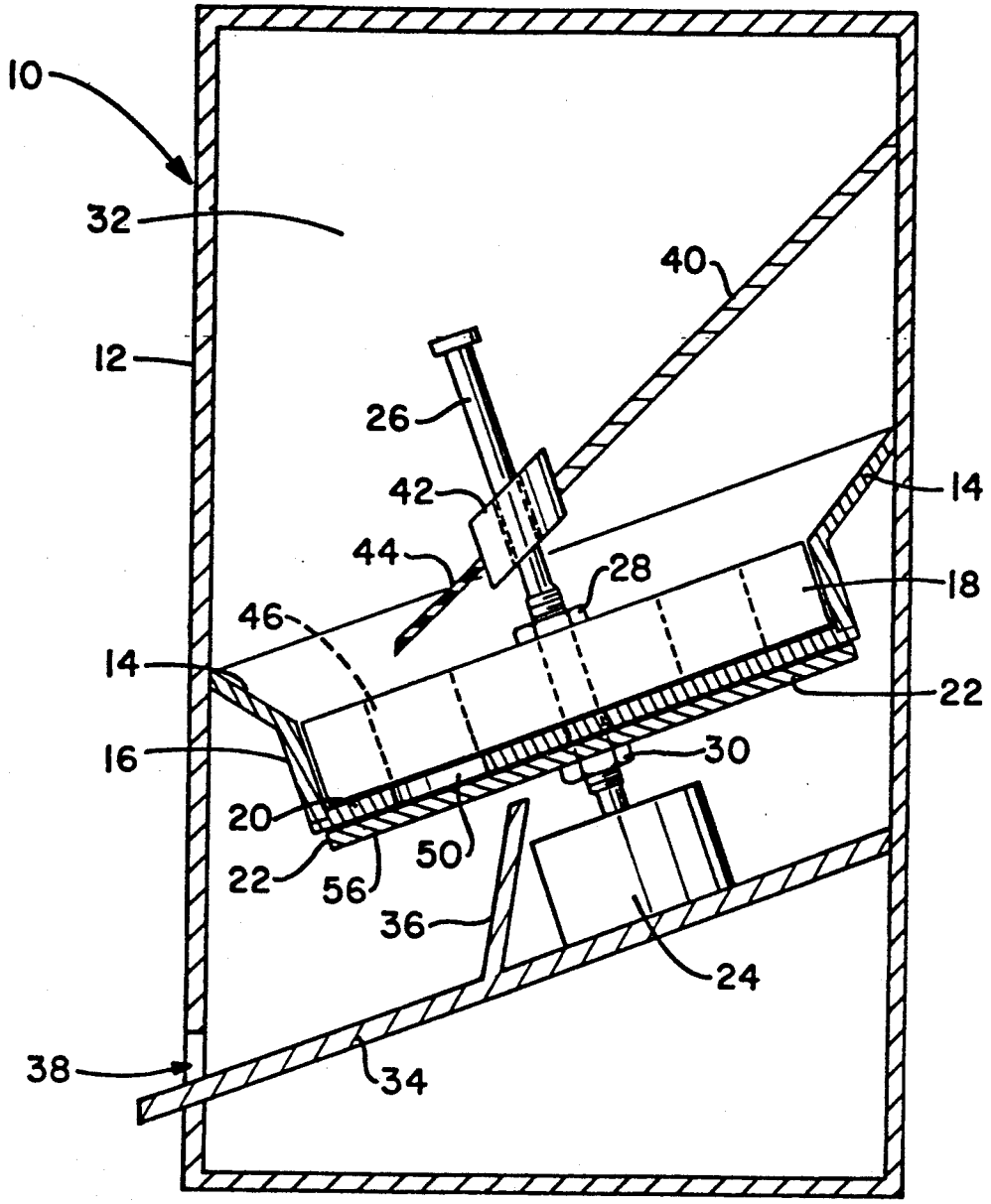
FIG. 1 is an illustrative partial sectional view of th internal structure of the bulk hopper of the invention.
Figure 2:
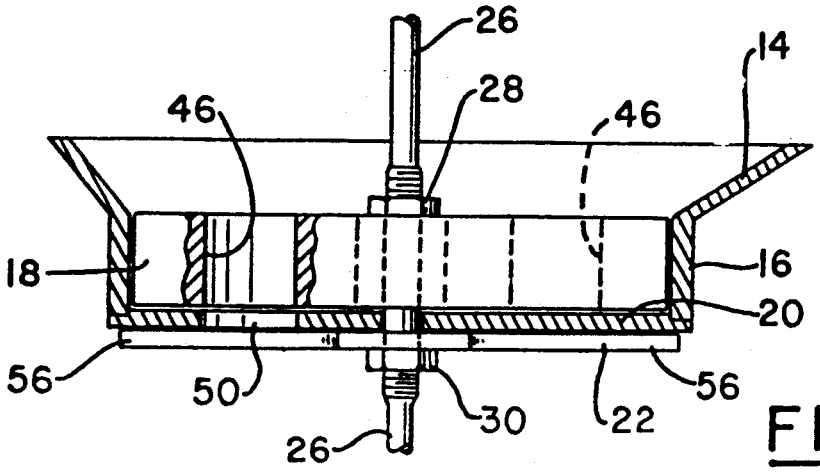
FIG. 2 is a cross sectional view of the dispensing mechanism employed in the bulk hopper of FIG. 1.
Figure 3:
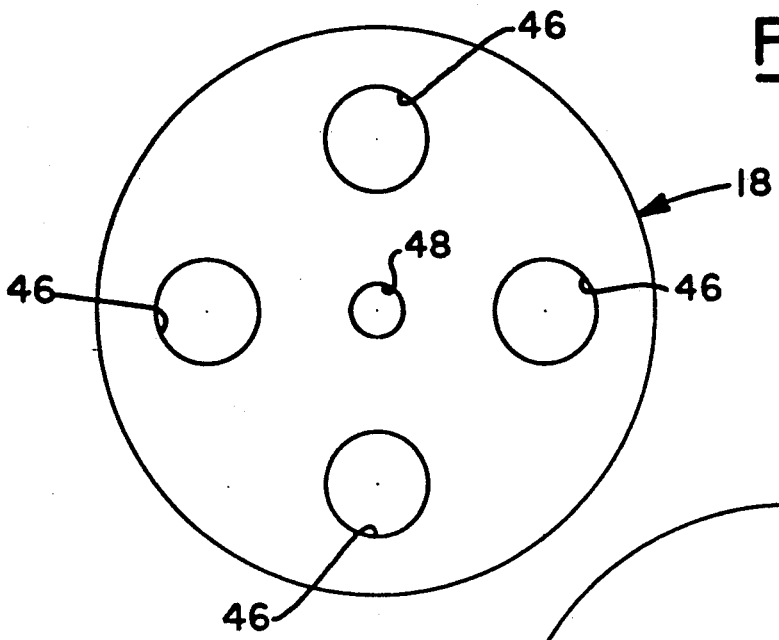
FIG. 3 is a top plan view of the pick-up wheel of the dispensing system of FIG. 2.
Figure 4:
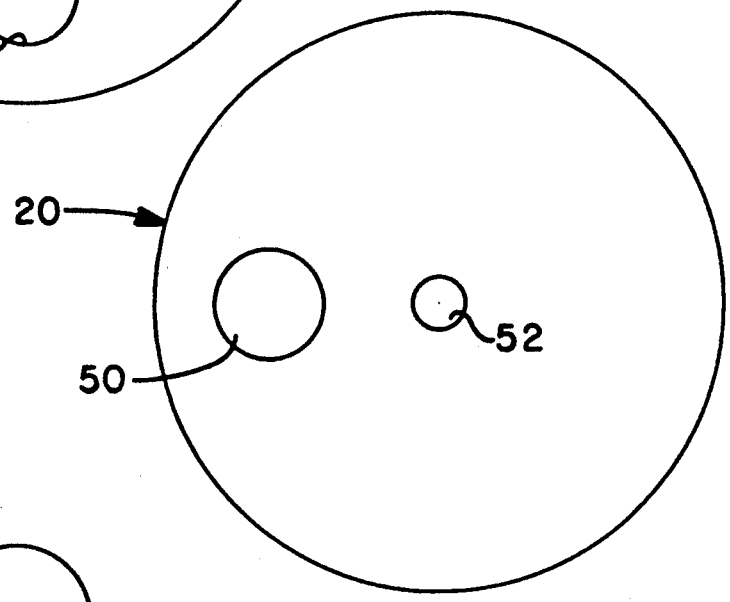
FIG. 4 is a top plane view of the stationary plate of the dispensing system of FIG. 2.
Figure 5:
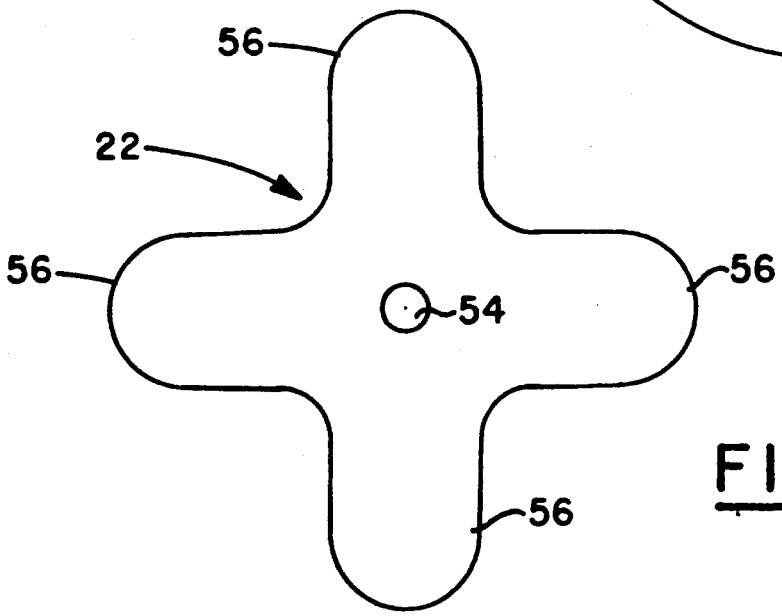
FIG. 5 is a top plan view of the pay-out plate of the dispensing system of FIG. 2.

Referring now to the drawings and more particularly FIG. 1, it can be seen that a coin hopper and dispenser according to the invention is designated generally by the numeral 10. A housing 12, typically of sheet metal construction, defines a rectangular box-like structure defining the coin hopper and dispenser 10. Inwardly sloping walls 14 extend from each of the vertical walls of the housing 12 to mate with a cylindrical housing 16 which, in turn, receives a coin-receiving disc or pick-up wheel 18. As shown, the walls 14, cylindrical housing 16, and disc 18 are angled with respect to the horizontal, such that the disc 18 provides a downward slope of 10°–30° from the horizontal.

A stationary plate 20 defines a bottom end of the cylindrical housing 16, while a pay-out plate or disc 22 is maintained parallel to the disc 18 and stationary plate 20.

Received within a bottom portion of the housing 12 is a motor 24 having a shaft 26 extending therefrom. The motor 24 is reversible, being driven in either clockwise or counterclockwise directions. Excitation of the motor 24 causes the shaft 26 to rotate about its axis. Connected to the shaft 2 is a pick-up wheel or coin-receiving disc 18 and the pay-out plate 22. Nuts or collars 28, 30 are received upon the shaft 26 for purposes of maintaining the disc 18 and plate 22 thereon. It will be appreciated that the disc 18 and plate 22 rotate in unison with the shaft 26 and in unison with each other.

The housing 12 defines a cavity 32 for receiving coins therein, such coins to be dispensed in a manner which will become apparent hereinafter. A dispensing plate 34, angled downwardly with respect to the horizontal, is provided beneath the assembly 18–22 to receive coins from the cavity 32 as dispensed by the assembly 18–22. The dispensing plate 34 is provided with a rear flange 36 to prevent coins from flipping into a bottom portion of the housing 12, such that the coins are dispensed through the opening 38 in the front wall of the housing 12.

A baffle plate 40, preferably of metallic or otherwise rigid construction, defines a back wall of the cavity 32 and extends into and out of the paper of FIG. 1 between sidewalls of the housing 12. The baffle plate 40 shields the coin-receiving disc 18 from the weight of the coins received within the cavity 32. A collar 42 is free floating upon the shaft 26 and is connected to the baffle plate 40. Extending from the collar 42 in a direction opposite that of the baffle plate 40 is a flap 44, preferably of flexible material such as rubber or the like. The purpose and function of the flap 44 will become apparent hereinafter.

With reference now to FIGS. 2–5, it can be seen that the coin-receiving disc 18 is provided with a plurality of uniformly spaced bores 46 about the central axis 48 thereof. The bores 46 pass entirely through the thickness of the disc 18, having a diameter on the order of 1.2 times the diameter of the coins to be received within the cavity 32 and to be dispensed from the opening 38. Typically, the thickness of the wheel 18 will be such as to accommodate 4–6 coins within each of the bores 46. It is preferred that the bores 46 and the disc 18 be of such relative diameters and spacings that the distance between each of the bores 46 will be greater than the diameters thereof. Of course, the bore 48 is adapted for receiving the motor shaft 26.

With further reference to FIGS. 2–5, it can be seen that the stationary plate 20 is provided with a bore 50 passing therethrough, having a diameter on the order of 1.2 times the diameter of the coins to be handled. Of course, a bore 52 is also provided for purposes of allowing the shaft 26 to pass therethrough. It should be appreciated that the spacing between the centers of the bores 50, 52 of the stationary plate 20 is equivalent to the spacing between the centers of the bores 46 and bore 48 in the disc 18. It should also be appreciated that the thickness of the plate 20 is preferably 1.1–1.3 times the thickness of the coins to be handled, and most preferably 1.2 times the thicknes of such coins.

Finally, it will be noted that the pay-out plate or disc 22 includes a bore 54 for receiving the shaft 26 and is characterized by a plurality of arms 56 radiating from the center thereof. The arms 56 are equal in number and spacing to the bores 46 of the disc 18, such that the arms 56 may be in alignment with the bores 46 when the bores 48, 54 are in axial alignment with each other. Indeed, it will be appreciated from the view of FIG. 2 that the discs 18, 22 are fixedly maintained upon the shaft 26 such that the arms 56 are in alignment with respective bores 46. Accordingly, as the shaft 26 rotates, either clockwise of counterclockwise, the bores 56 will successively come into alignment with the bore 50 of the plate 20. At this point in time, one coin received within the aligned bore 46 will drop into the bore 50 and be supported therein by the associated arm 56. As rotation continues, the coins in the bore 46 will be supported by the plate 20, while the coin within the bore 50 will drop therefrom as the arm 56 leaves the bottom of that bore. Accordingly, such coin will drop onto the dispensing plate 34 and out of the opening 38. Obviously, as rotation of the assembly 18, 22, 26 continues, successive singular dispensing of coins will occur as the bores 46 are replenished from the coins in the cavity 32.

With an understanding of the forgoing structure, the operation of the invention should now become apparent. The cavity 32 of the housing 12 is filled with coins of a single denomination. The coins load down the baffle 40, which is free floating by means of the collar 42 received upon the shaft 26. When the dispensing of coins is requested by an associated changer, the motor 24 causes the shaft 26 to rotate. The flexible rubber flap 44, riding above a lower top surface of the disc 18, prevents the coins from jamming, wedging, rolling, or bridging, while urging the coins into the bores 46 of the disc 18. The flap 44 allows for low energy mixing and tumbling of the coins in the violent zone of the hopper. The space beneath and shielded by the baffle 40 and flap 44 has a limited number of coins therein, providing for ease of loading of the coins into the bores 46. As the disc 18 rotates, each time a bore 46 comes into registration with the bore 50 of the plate 20, a coin is passed from the bore 46 to the bore 50, being temporarily retained therein by the associated arm 56 which is in registration with the bore 46. As rotation continues, the arm 56 passes from beneath the bore 50, allowing the coin to be dispensed. Rotation continues until the appropriate number of coins have been dispensed. Should a jam or other problem occur, the direction of the rotation of the motor 24 can be reversed in an attempt to break the jam wedge or the like.

It will be appreciated by those skilled in the art that maintenance of registration of the discs 18, 22 can be readily achieved by such means as keying the shaft 26, or otherwise providing for such registration. It will also be appreciated that the number of bores 46 within the disc 18 and the size of the discs 18, 20, 22 can vary, depending upon the application desired. It is, however, most desirable that the spacing between the bores 46 of the disc 18 be greater than the diameter of the bores themselves, assuring the clearing of the bore 50 on each coin disbursal before another coin begins to enter that bore.

Thus it can be seen that the objects of the invention have been satisfied by the structure presented above. While in accordance with the patent statutes only the best mode and preferred embodiment of the invention has been pesented and described in detail, it is to be understood that the invention is not limited thereto or thereby. Accordingly, for an appreciation of the true scope and breadth of the invention reference should be made to the following claims.

What is claimed is:

1. A coin dispenser, comprising:

a hopper for receiving a bulk supply of coins;

first and second rotatable plates positioned at a bottom end of said hopper. said first rotatable plate comprising a disc having a plurality of bores passing therethrough, said bores adapted to receive coins from said hopper, and said second rotatable plate comprising a plurality of arms extending from a central axis, said arms being in fixed registration with said bores, there being an equal number of said bores and arms, said first and second rotatable plates being affixed to a common rotatable shaft;

a third stationary plate interposed between said first and second rotatable plates, said third stationary plate having a bore passing therethrough in periodic alignment with said bores of said first rotating plate; and a baffle plate within said hopper, shielding said first rotatable plate from coins received within said hopper, said baffle plate extending from a collar received by said shaft to a back wall of said hopper.

2. The coin dispenser according to claim 1, wherein said first and second rotatable plates rotate in planes oblique to the horizontal.

3. The coin dispenser to claim 2, wherein said stationary plate has a thickness of between 1.1 and 1.3 times the thickness of coins received within said hopper.

4. The coin dispenser according to claim 2, further comprising a flap maintained in juxtaposition to a lower surface of said first rotatable plate.

5. The coin dispenser according to claim 4, wherein said flap is flexible and floatingly received upon said shaft.

6. A coin dispenser, comrpising:

a hopper for receiving coins;

first and second discs closing a bottom end of said hopper, said first and second discs being affixed to a shaft and being rotatable in unison by rotation of said shaft, said first and second discs being oblique to horizontal and vertical planes, said first disc having a plurality of bores uniformly spaced about an axis thereof, and wherein said second disc has a plurality of arms extending outwardly from and uniformly spaced about said axis;

a stationary plate interposed between said first and seocnd discs;

a flap adjacent a lower surface of said disc, said flap being floatingly supported to move toward and away from said lower surface of said disc; and a baffle plate extending over an upper surface of said first disc, said baffle plate shielding said first disc from weight of coins received within said hopper, said baffle plate and said flap both being extended from a collar slidingly received upon said shaft.

7. The coin dispenser as recited in claim 6 wherein each of said bores is in registration with one of said arms.

8. The coin dispenser as recited in claim 7, wherein said stationary plate has a bore passing through a lower portion thereof.

9. A coin dispenser, comprising:

a hopper for receiving a bulk supply of coins;

first and second rotatable plates positioned at a bottom end of said hopper, said first rotatable plate comprising a disc having a plurality of bores passing therethrough, said bores adapted to receive coins from said hopper, and said second rotatable plate comprising a plurality of arms extending from a central axis, said arms in fixed registration with said bores, there being an equal number of said bores and arms, said first and second rotatable plates being affixed to a common rotatable shaft;

a third stationary plate interposed between said first and second rotatable plates, said third stationary plates having a bore passing therethrough in periodic alignment with said bores of said first rotatable plate; and a flap maintained in juxtaposition to a lower surface of said first rotatable plate, said flap being flexible and floatingly received upon said shaft.

* * * * *